US011165204B2

(12) United States Patent
Ishida et al.

(10) Patent No.: US 11,165,204 B2
(45) Date of Patent: Nov. 2, 2021

(54) PLUG AND SOCKET HAVING A SHIELD PLATE TO GROUND PLATE CONNECTION

(71) Applicant: SMK Corporation, Tokyo (JP)

(72) Inventors: Yoshiyasu Ishida, Saitama (JP); Toshihiko Kato, Kanagawa (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 16/831,900

(22) Filed: Mar. 27, 2020

(65) Prior Publication Data

US 2021/0143586 A1 May 13, 2021

(30) Foreign Application Priority Data

Nov. 12, 2019 (JP) ..... JP2019-204387

(51) Int. Cl.
*H01R 13/6585* (2011.01)
*H01R 12/71* (2011.01)

(52) U.S. Cl.
CPC ..... *H01R 13/6585* (2013.01); *H01R 12/716* (2013.01)

(58) Field of Classification Search
CPC .... H01R 12/716; H01R 12/712; H01R 12/51; H01R 12/52; H01R 12/73; H01R 13/6585; H01R 13/6581; H01R 13/6583; H01R 13/6596
See application file for complete search history.

(56) References Cited

U.S. PATENT DOCUMENTS

| | | | | |
|---|---|---|---|---|
| 10,249,969 | B2 * | 4/2019 | Ono | H01R 13/504 |
| 10,361,516 | B2 * | 7/2019 | Freer | H01R 13/641 |
| 10,644,419 | B2 * | 5/2020 | Ishida | H01R 13/6581 |
| 10,644,420 | B1 * | 5/2020 | Ishida | H01R 12/7088 |
| 10,673,159 | B2 * | 6/2020 | Ishida | H01R 12/721 |
| 2017/0070008 | A1 | 3/2017 | Masato | |
| 2019/0280409 | A1 | 9/2019 | Hiroyuki | |

FOREIGN PATENT DOCUMENTS

| | | | |
|---|---|---|---|
| JP | 2011146210 | A | 7/2011 |
| JP | 2017050235 | A | 3/2017 |
| JP | 2018116925 | A | 7/2018 |

* cited by examiner

*Primary Examiner* — Vanessa Girardi

(57) ABSTRACT

A connector with enhanced suppression and shieldability of signal interference between signal terminals is provided. A connector includes a ground plate made of conductive metal, the ground plate being placed beside a fitting groove of a socket housing. A plug includes a shield plate made of a conductive plate member beside a plug-side signal terminal, and a surface of the shield plate is opposed to a top end surface of the ground plate. The connector can ensure cooperation between the shield plate and the ground plate and enhance suppression and shieldability of signal interference between the signal terminals.

9 Claims, 16 Drawing Sheets

PLUG AND SOCKET HAVING A SHIELD PLATE TO GROUND PLATE CONNECTION

CROSS REFERENCE TO RELATED APPLICATION

The contents of the following Japanese patent application are incorporated herein by reference, Japanese Patent Application No. 2019-204387 filed on Nov. 12, 2019.

FIELD

The present invention relates to a connector that electrically connects, mainly, a substrate to a substrate, a substrate to a cable, etc.

BACKGROUND

A connector used to connect a substrate to a substrate includes a plug having a fitting protrusion of rib shape on which one or a plurality of plug-side signal terminals are arranged, and a socket including one or a plurality of socket-side signal terminals arranged in a fitting groove for the fitting protrusion to be inserted into. The two types of signal terminals are in contact with each other for electrical connection by fitting the fitting protrusion to the fitting groove.

This type of connector may include plug-side ground terminals to be grounded and socket-side ground terminals. The plug-side ground terminals are arranged on the fitting protrusion in parallel with the plug-side signal terminals. The socket-side ground terminals are arranged in the fitting groove in a manner corresponding to the respective plug-side ground terminals.

This type of connector can include a plurality of fitting protrusions on the plug. The fitting protrusions are fitted to respective fitting grooves that are located in parallel, with a wall member made of an insulating resin therebetween. Plug-side signal terminals arranged on the fitting protrusions are in contact with socket-side signal terminals arranged in the corresponding fitting grooves.

However, a connector including signal terminals arranged on both sides of a wall member can cause signal interference, such as crosstalk, between the signal terminals located with the wall member therebetween.

In view of this, connectors including a ground plate made of conductive metal in a wall member have heretofore been known (for example, see Patent Literature 1). The ground plate is grounded to suppress signal interference, such as crosstalk, between signal terminals located with the ground plate in the wall member therebetween.

As connectors of this type, one including a flat-shaped ground plate vertically placed both between the terminal rows of a plug and between those of a socket for improved shielding performance (for example, see Patent Literature 2) and one in which shield terminals to be connected to a ground plate located on a socket are arranged between the terminal rows of a plug (for example, see Patent Literature 3) have been known.

CITATION LIST

Patent Literature

Patent Literature 1: Japanese Patent Application Laid-Open No. 2011-146210

Patent Literature 2: Japanese Patent Application Laid-Open No. 2017-050235

Patent Literature 3: Japanese Patent Application Laid-Open No. 2018-116925

SUMMARY

Technical Problem

However, according to the conventional technique described in the foregoing Patent Literature 2, both the plug and socket include a vertically-placed ground plate. Since both the plug and socket need to have a height capable of holding the vertically-placed ground plate, there has been a problem that the total height of the connector inevitably increases accordingly.

According to this conventional technique, no connection is established between the plug-side ground plate and the socket-side ground plate. If the connector is subjected to vibrations and the like, the plug-side ground plate and the socket-side ground plate can be separated to lower the noise cut-off capability.

On the other hand, according to the conventional technique described in the foregoing Patent Literature 3, there is a connection structure between the plug-side shield terminals and the ground plate. Since the plug-side shield terminals are shaped to have a three-dimensional structure and the cut-off between the terminal rows becomes discontinuous, there has been a problem of difficulty in completely cutting off noise occurring between the signal terminals.

In addition, the presence of the connection structure between the shield terminals and the socket-side ground plate complicates the shapes of the shield terminals and the ground plate. There has thus been another problem that the cost increases accordingly.

The present invention has been achieved in view of the foregoing conventional problems, and an object thereof is to provide a connector with enhanced suppression and shieldability of signal interference between signal terminals.

Solution to Problem

To solve the foregoing conventional problems, a first aspect of the present invention is a connector including a plug configured to include a plug housing having a fitting protrusion of rib shape and one or a plurality of plug-side signal terminals arranged on the fitting protrusion, and a socket configured to include a socket housing having a fitting groove for the fitting protrusion to be fitted into, one or a plurality of socket-side connection terminals arranged in the fitting groove, and a ground plate made of conductive metal, the ground plate being held by the socket housing and vertically placed beside the fitting groove, the plug-side signal terminal(s) and the socket-side signal terminal(s) being in contact with each other by fitting the fitting protrusion to the fitting groove. In this configuration, the plug is configured to include a shield plate made of a conductive plate member beside the plug-side signal terminal(s), a surface of the shield plate being opposed to a top end surface of the ground plate.

In a second aspect of the present invention, in addition to the configuration according to the first aspect, the shield plate is configured to include a plug-side coupling metal piece exposed on a side end surface of the plug housing, and the plug-side coupling metal piece is connected to a socket-side shield member.

In a third aspect of the present invention, in addition to the configuration according to the first or second aspect, the shield plate is configured to include a surface mounting terminal portion exposed on a substrate mounting side of the plug housing.

In a fourth aspect of the present invention, in addition to the configuration according to any one of the first to third aspects, the ground plate is held by the socket housing with part or all of the top end surface thereof exposed, and the shield plate is configured to include a plate contact portion to make contact with the top end surface of the ground plate.

In a fifth aspect of the present invention, in addition to the configuration according to the fourth aspect, the plate contact portion is formed like a spring supported at one end by an inner rim of a window portion penetrating through the shield plate in a thickness direction.

In a sixth aspect of the present invention, in addition to the configuration according to the fourth aspect, the plate contact portion is formed like a rib protruding from a ground plate-side surface of the shield plate.

In a seventh aspect of the present invention, in addition to the configuration according to the sixth aspect, the shield plate is configured to include a pair of shield plate members each including a shield plate main body of flat plate shape and a plate contactor perpendicularly protruded from a side edge of the shield plate main body, and the plate contact portion is formed by combining the plate contactors.

In an eighth aspect of the present invention, in addition to the configuration according to the seventh aspect, ground plate-side ends of the plate contactors are connected by a connection portion.

In a ninth aspect of the present invention, in addition to the configuration according to the third aspect, the ground plate is configured to include a plate connection portion that elastically makes contact with the shield plate exposed from a bottom plate portion of the plug housing.

Since the connector according to the present invention has the configuration according to the first aspect, the shield plate constitutes a skeleton of a bottom plate portion. The entire connector can thus be made low-profile even if the shield plate for cutting off the plug-side signal terminals held by the fitting protrusion from each other is included.

In addition, since the connector according to the present invention has the configuration according to the second aspect, the parts count and the man-hour for parts fabrication can be reduced. In addition, the shield plate and the plug-side coupling metal piece can be simultaneously assembled into the plug housing. With the ground plate and the socket-side shield member connected, the shield plate and the ground plate can be connected via the socket-side shield member by connecting the plug to the socket. This can ensure cooperation between the shield plate and the ground plate in terms of shielding performance.

In addition, since the connector according to the present invention has the configuration according to the third second, the shield plate can be directly grounded by surface mounting.

In addition, since the connector according to the present invention has the configuration according to any of the fourth to ninth aspects, connection between the shield plate and the ground plate can be achieved, whereby high shieldability can be obtained.

DESCRIPTION OF EMBODIMENTS

Figure 1:
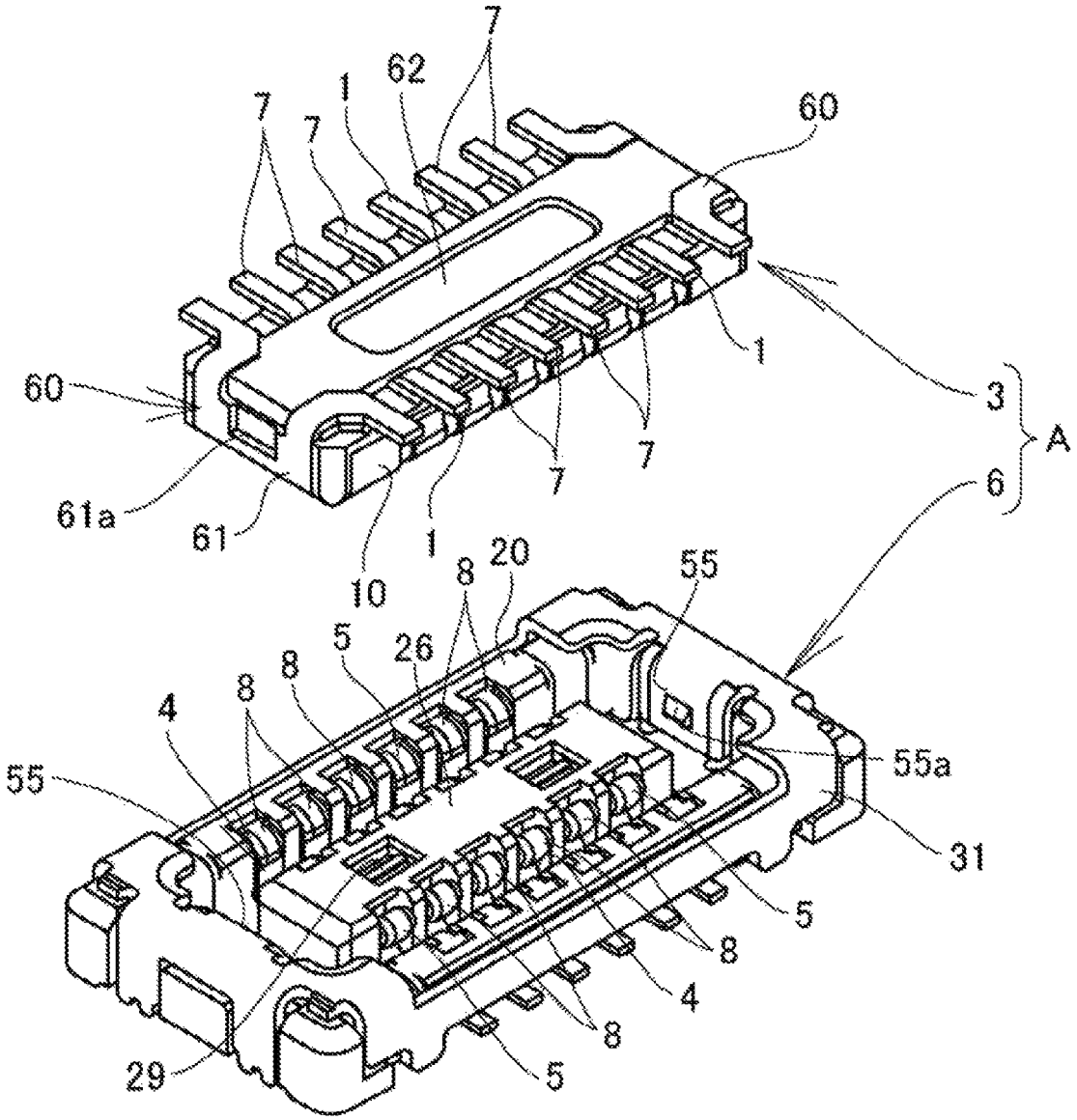
FIG. 1 is an exploded perspective view showing an example of a connector according to the present invention.
Figure 2:
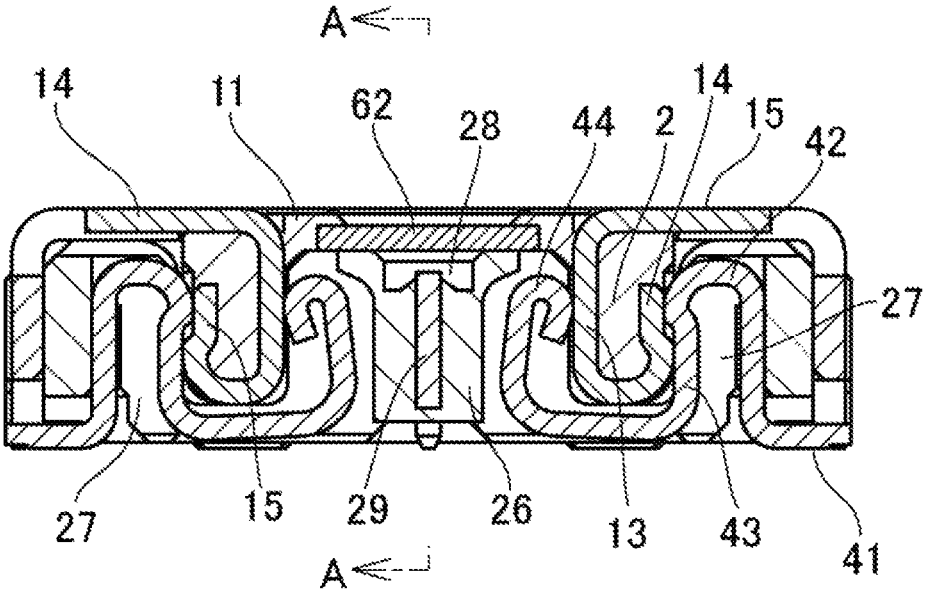
FIG. 2 is a sectional view showing a state of connection of the connector.
Figure 3:
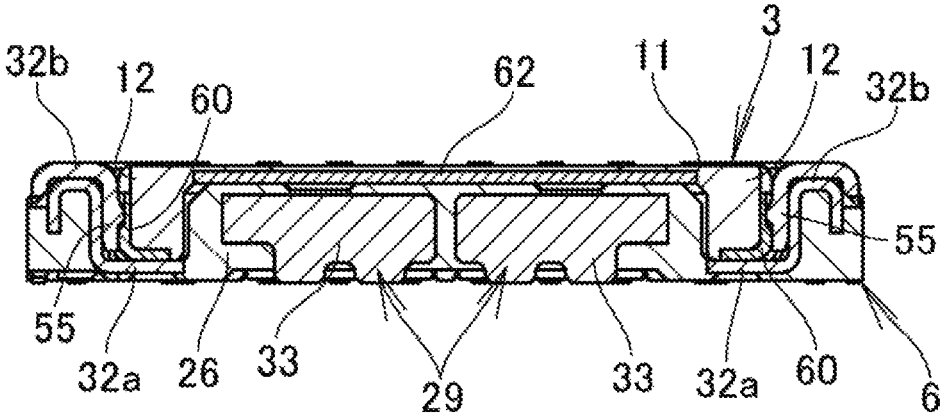
FIG. 3 is a sectional view of the connector, taken along the line A-A.

Next, an embodiment of a connector according to the present invention will be described on the basis of examples shown in FIGS. 1 to 19. In the drawings, a reference symbol A denotes a connector.

As shown in FIG. 1, the connector A includes a plug 3 and a socket 6. The plug 3 includes fitting protrusions 2, 2 of ridge shape on which a plurality of plug-side signal terminals 1, 1 are arranged. The socket 6 includes a plurality of socket-side signal terminals 5, 5 arranged in fitting grooves 4, 4 for the fitting protrusions 2, 2 to be inserted into. The two types of signal terminals 1 and 5 are in contact with each other for electrical connection by fitting the fitting protrusions 2, 2 to the fitting grooves 4, 4.

The connector A includes plug-side ground terminals 7, 7 to be grounded and socket-side ground terminals 8, 8. The plug-side ground terminals 7, 7 are arranged on the fitting protrusions 2, 2 in parallel with the plug-side signal terminals 1, 1. The socket-side ground terminals 8, 8 are arranged in the fitting grooves 4, 4 in a manner corresponding to the respective plug-side ground terminal 7, 7.

Figure 4A:
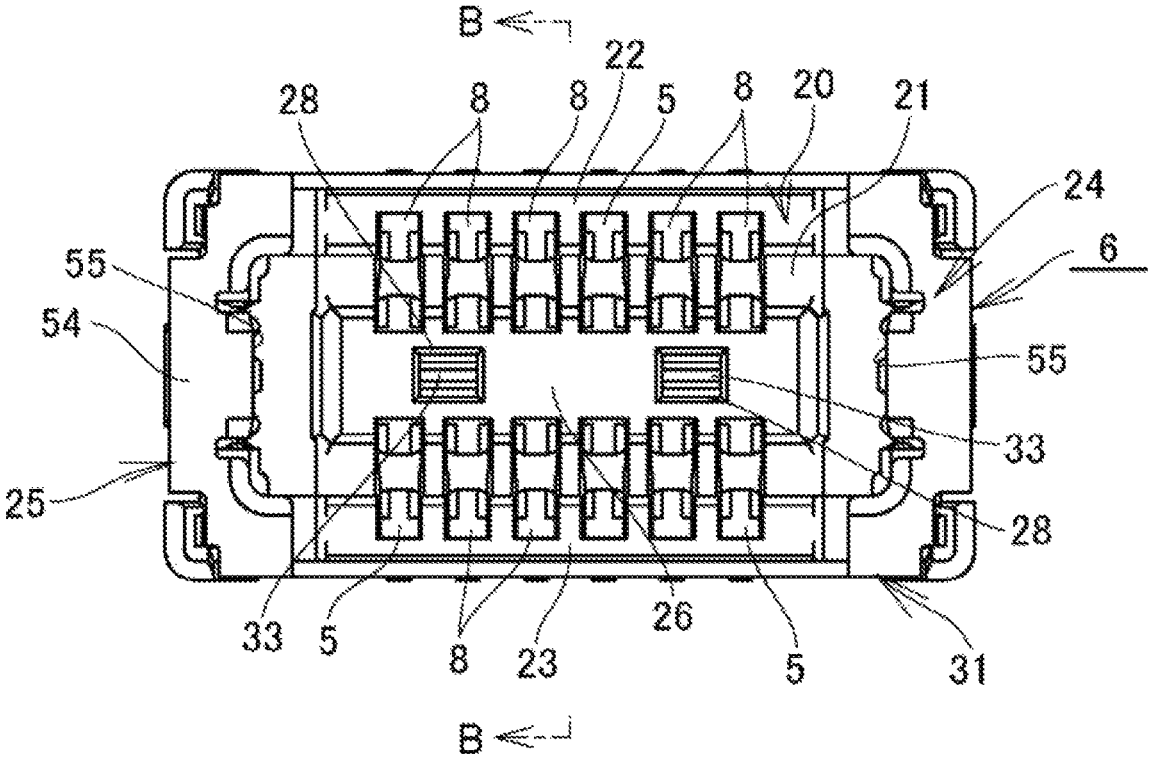
FIG. 4A is a plan view showing a socket of the connector.
Figure 4B:
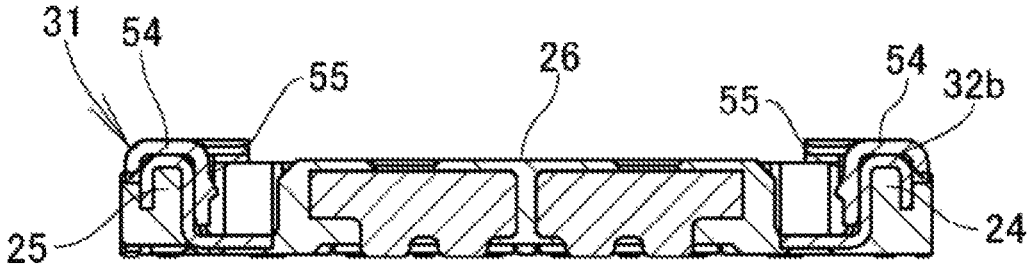
FIG. 4B is a longitudinal sectional view of the connector.
Figure 4C:
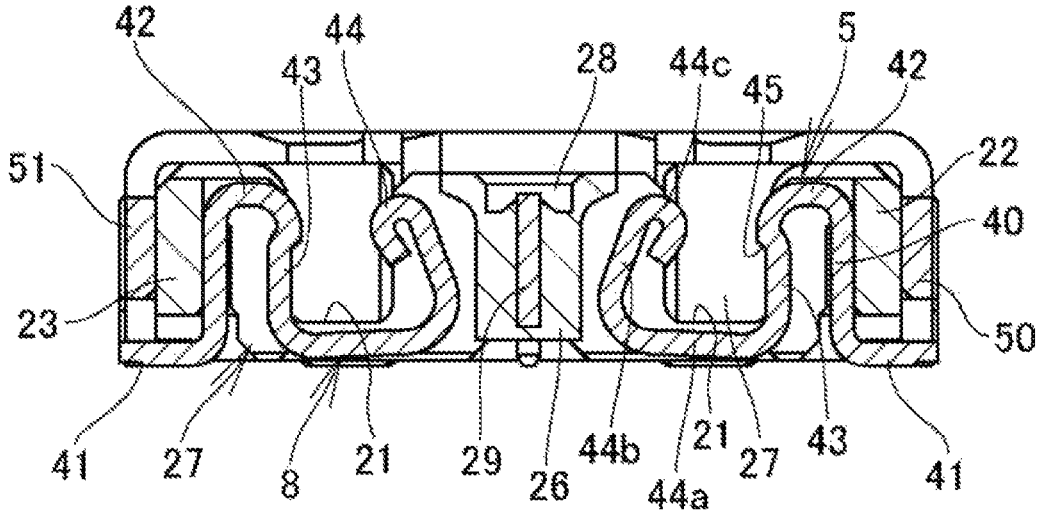
FIG. 4C is an enlarged sectional view of the connector, taken along the line B-B.

As shown in FIGS. 4A to 4C, the socket 6 includes a socket housing 20 made of an insulating resin, one or a plurality of socket-side signal terminals 5, 5 arranged in the fitting grooves 4, 4, and one or a plurality of socket-side ground terminals 8, 8 arranged in the fitting grooves 4, 4. The socket 6 is formed by assembling the socket-side signal terminals 5, 5 and the socket-side ground terminals 8, 8 into the socket housing 20.

The socket housing 20 includes peripheral walls 22 to 25 erected from an outside rim of a flat-shaped bottom plate portion 21, and a plate holding wall portion 26 located in the center of the bottom plate portion 21. The fitting grooves 4, 4 for the fitting protrusions 2, 2 to be inserted into are formed in parallel between the peripheral walls 22 to 25 and the plate holding wall portion 26.

The outer surfaces of the peripheral walls 22 to 25 of the socket housing 20 are covered with a socket-side shield member 31 made of conductive metal material.

Terminal insertion portions 27, 27 of recessed hole shape opening in the bottom surface are formed in the socket housing 20. The terminal insertion portions 27, 27 are formed across the peripheral walls 22 and 25 and the plate holding wall portion 26.

The plate holding wall portion 26 holds ground plates 29 made of conductive metal plates. The ground plates 29 are located beside the fitting grooves 4, 4.

Plate exposure windows 28, 28 are formed in the plate holding wall portion 26. The plate exposure windows 28, 28 open in the top surface and expose part or all of top end surfaces of the ground plates 29.

Figure 5:
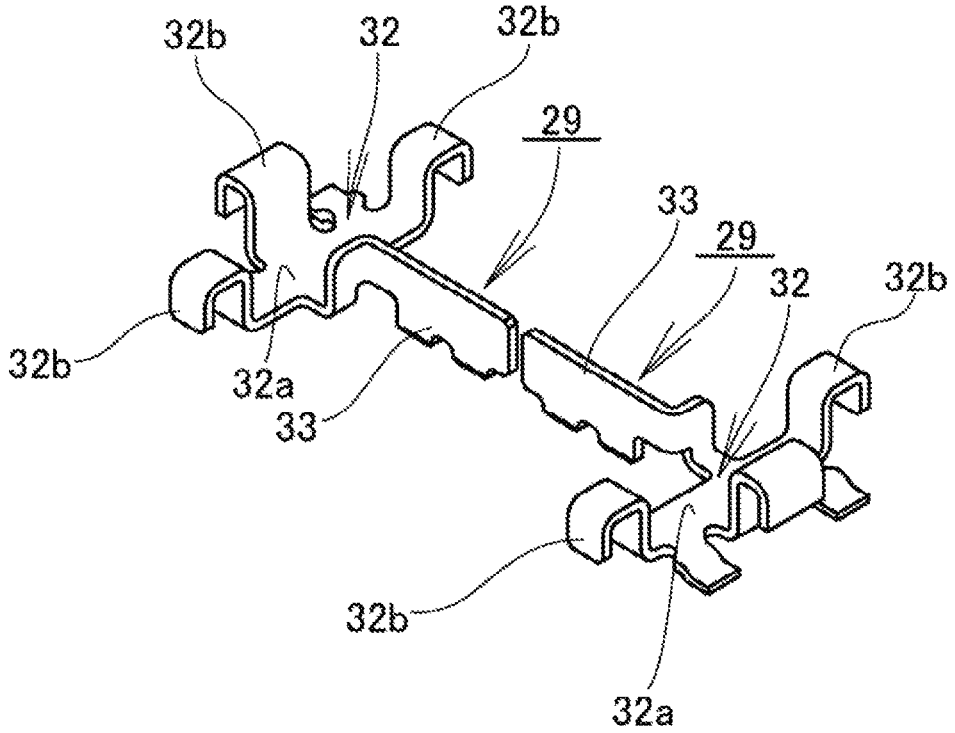
FIG. 5 is a perspective view showing ground plates of the socket.

As shown in FIG. 5, the ground plates 29 are made of conductive metal plates, and include connection portions 32 to be connected to the socket-side shield member 31 and plate main bodies 33 supported by the connection portions 32. The ground plates 29 are assembled into the socket housing 20 so that the plate main bodies 33 are erected with their thickness direction horizontal and located inside the plate holding wall portion 26.

The connection portions 32 each include a support plate portion 32*a* of flat plate shape and cover contactors 32*b* supported on both sides and one end edge of the support plate portion 32*a*. The plate main body 33 is integrally supported on the other end edge of the support plate portion 32*a*.

The cover contactors 32*b* are exposed on the top and side surfaces of the respective corresponding peripheral walls 22 to 25. When the socket-side shield member 31 is assembled to the socket housing 20, the cover contactors 32*b* are fitted to the interior of the socket-side shield member 31, whereby the cover contactors 32*b* and the socket-side shield member 31 are in contact with each other.

Figure 6:
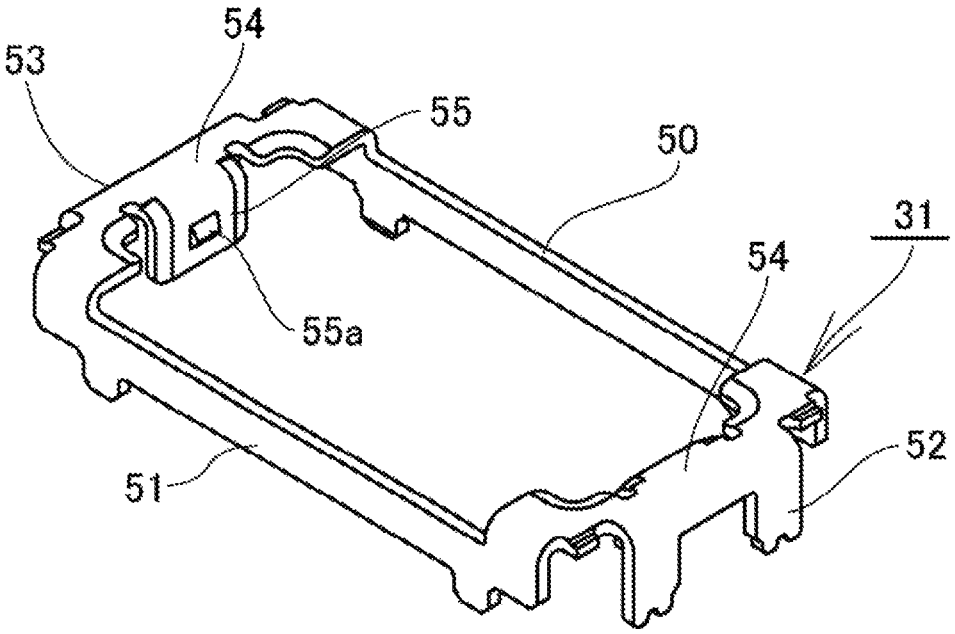
FIG. 6 is a perspective view showing a socket-side shield member of the connector.

As shown in FIG. 6, the socket-side shield member 31 is formed by punching and folding a conductive metal plate member. The socket-side shield member 31 includes peripheral wall portions 50 to 53, top covering portions 54, 54, and socket-side coupling metal pieces 55, 55. The peripheral wall portions 50 to 53 cover the outer periphery of the socket housing 20. The top covering portions 54, 54 cover the top surfaces of the peripheral walls 24 and 25 at both ends of the socket housing. The socket-side coupling metal pieces 55, 55 have a plate shape and are supported by the top covering portions 54, 54. When the socket-side shield member 31 is assembled to the socket housing 20, the socket-side coupling metal pieces 55, 55 are inserted to inside the peripheral walls 24 and 25 and fit to the cover contactors 32*b*.

The socket-side coupling metal pieces 55, 55 each include an engagement protrusion 55*a* protruding from the surface. The plug 3 and the socket 6 are fixed by engaging the engagement protrusions 55*a* with engagement recesses 61*a* formed in plug-side coupling metal pieces 60, 60 located on side end surfaces of the plug housing 10 to be described later.

Figure 7A:
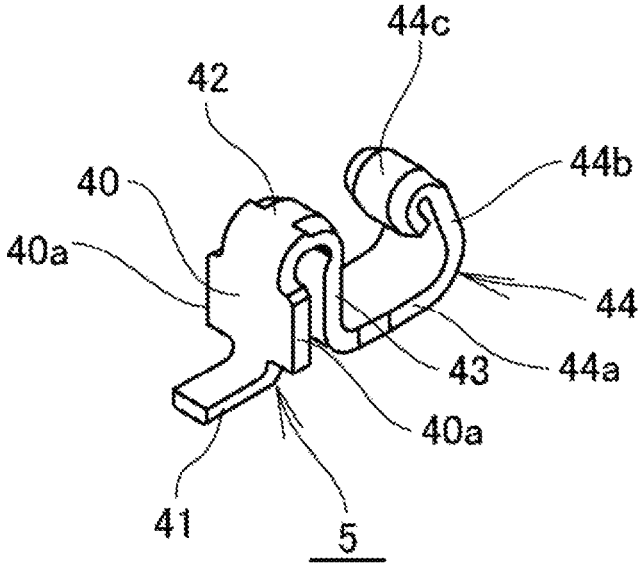
FIG. 7A is a perspective view showing a socket-side signal terminal or a socket-side ground terminal seen in a direction.
Figure 7B:
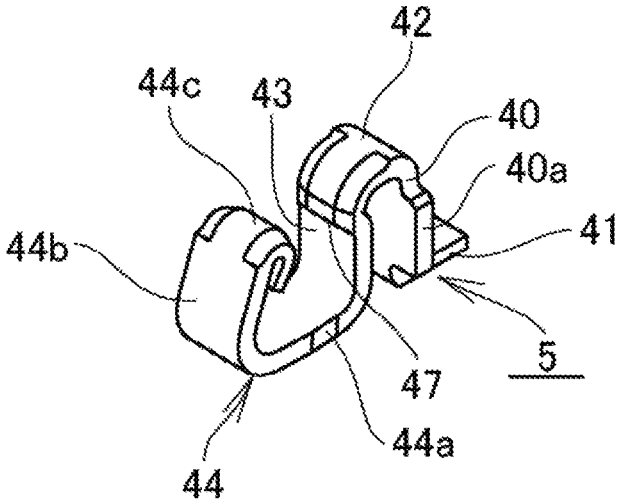
FIG. 7B is an another perspective view showing a socket-side signal terminal or a socket-side ground terminal seen in another direction.

The socket-side signal terminals 5 and the socket-side ground terminals 8 are formed in the same shape. As shown in FIGS. 7A and 7B, each terminal is integrally formed by punching a conductive metal plate member to form a punched member of predetermined shape, and folding the punched member in a thickness direction. The socket-side signal terminals 5 and the socket-side ground terminals 8 each include a terminal base piece 40, a substrate connection terminal piece 41, a connection piece 42, a socket-side engagement portion 43, and an elastic contactor 44. The terminal base piece 40 is fixed to the socket housing 20. The substrate connection terminal piece 41 is shaped by bending one end (bottom end) of the terminal base piece 40 perpendicularly outward. The connection piece 42 is folded back in an arc shape from the other end of the terminal base piece 40. The socket-side engagement portion 43 is swingably supported by the other end of the connection piece 42. The elastic contactor 44 is supported by the bottom end of the socket-side engagement portion 43.

The socket-side signal terminals 5 and the socket-side ground terminals 8 are assembled to the terminal insertion portions 27, 27 . . . of the socket housing 20 at respective predetermined positions from the bottom side. The terminal base pieces 40 are thereby fixed to the peripheral walls 22 and 23, the socket-side engagement portions 43 are exposed to the inner peripheral sides of the peripheral walls 22 to 25, and the elastic contactors 44 are protruded from the outside surfaces of the plate holding wall portion 26.

The terminal base pieces 40 are each formed in a rectangular shape and have fixing protrusions 40*a*, 40*a* protruding from both side edges thereof. When the terminal base pieces 40 are inserted through insertion grooves formed in the terminal insertion portions 27 formed in the socket housing 20, the fixing protrusions 40*a*, 40*a* bite into the inner rims of the insertion grooves, whereby the terminal base pieces 40 are fixed to the peripheral walls 22 and 23.

A holding rib portion (hereinafter, referred to as a socket-side holding rib portion 47) continuous in a direction crossing a plug insertion and removal direction is formed on each socket-side engagement portion 43 by folding the punched member in a thickness direction. The socket-side engagement portion 43 is thereby configured to engage with a plug-side holding rib portion 17.

The elastic contactor 44 includes an elastic base 44*a* and an elastic contact portion 44*b*. The elastic base 44*a* is obliquely extended from the bottom end of the socket-side engagement portion 43. The elastic contact portion 44*b* is folded back obliquely upward from the end of the elastic bottom 44*a*. The extremity of the elastic contact portion 44*b* is bent in an arc shape. A contact 44*c* is formed at the end of the elastic contact portion 44*b*.

The elastic contactors 44 are arranged so that the elastic bases 44*a* traverse under the fitting grooves 4, 4. The extremities of the elastic contact portions 44*b* folded back obliquely upward from the ends of the elastic bases 44*a* protrude from the outside surfaces of the plate holding wall portion 26 into the fitting grooves 4, 4 and make contact with contact portion pieces 13 of the plug 3.

As shown in FIGS. 8A to 8D, the plug 3 includes the plug housing 10 including the fitting protrusions 2, 2 of rib shape, one or a plurality of plug-side signal terminals 1, 1 arranged on the fitting protrusions 2, 2, and one or a plurality of plug-side ground terminals 7, 7 arranged on the fitting protrusions 2, 2. The plug-side signal terminals 1, 1 and the plug-side ground terminals 7, 7 are built in the plug housing 10 by insert molding.

The plug housing 10 includes a pair of fitting protrusions 2, 2 of rib shape and end wall portions 12, 12. The fitting protrusions 2, 2 protrude from a bottom plate portion 11 and are parallel to each other. The end wall portions 12, 12 connect the ends of the two fitting protrusions 2, 2. The fitting protrusions 2, 2 and the end wall portions 12, 12 form a rectangular frame when seen in a plan view. The plug-side signal terminals 1, 1 and the plug-side ground terminals 7, 7 are built in the fitting protrusions 2, 2.

The plug-side coupling metal pieces 60, 60 made of a conductive metal material are located on both ends of the plug housing 10. When the plug 3 is connected to the socket 6, the plug-side coupling metal pieces 60, 60 are engaged with the socket-side coupling metal pieces 55, 55 of the socket-side shield member 31.

The plug-side coupling metal pieces 60, 60 include engagement plate portions 61 exposed on both end surfaces of the plug housing 10. The engagement recesses 61*a* to be engaged with the engagement protrusions 55*a* are formed in the centers of the respective engagement plate portions 61.

A shield plate 62 made of a conductive plate member is built in the bottom plate portion 11 of the plug housing 10. The surface of the shield plate 62 is opposed to the top end surfaces of the ground plates 29 and located beside the plug-side signal terminals 1.

A plate exposure portion 63 is formed in the bottom plate portion 11 of the plug housing 10. The plate exposure portion 63 opens at least on the socket-side surface of the bottom plate portion 11, and the shield plate 62 is exposed to the socket side via the plate exposure portion 63.

Figure 9:
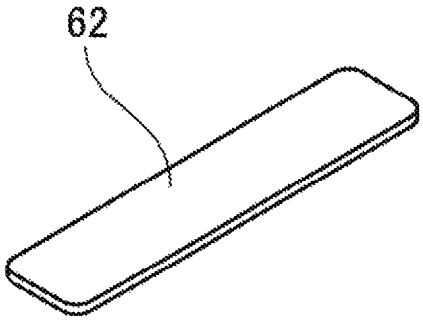
FIG. 9 is a perspective view showing an example of a shield plate in FIGS. 8A, 8B, 8C, and 8D.

As shown in FIG. 9, the shield plate 62 is made of a conductive metal plate member in a flat plate shape, and built in the bottom plate portion 11 of the plug housing 10 by insert molding. The shield plate 62 cuts off the signal terminals held by the fitting protrusions 2, 2 from each other, and constitutes a skeleton of the bottom plate portion 11.

The configuration of the shield plate 62 is not limited to the one shown in FIG. 9. Various configurations shown in FIGS. 10, 12, 14, 17, and 19 can be employed to improve the shielding performance and provide other additional operations and effects. In the following description, similar components to those of the foregoing example will be denoted by the same reference numerals.

Figure 10:
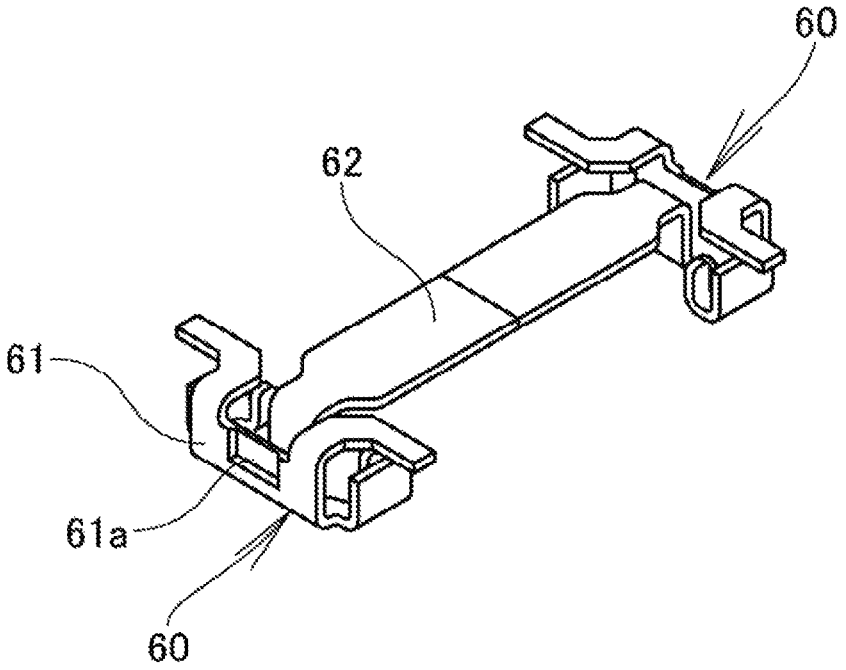
FIG. 10 is a perspective view showing another configuration of the shield plate.

FIG. 10 shows shield plates 62 that include plug-side coupling metal pieces 60, 60 at both sides of the shield plates 62 of flat plate shape. The plug-side coupling metal pieces 60, 60 are integrated with the shield plates 62.

Such shield plates 62 enable integral formation of the shield plates 62 and the plug-side coupling metal pieces 60, 60. This can reduce the parts count and the man-hour for parts fabrication. In addition, the shield plates 62 and the plug-side coupling metal pieces 60, 60 can be simultaneously built into the plug housing 10.

Figure 11:
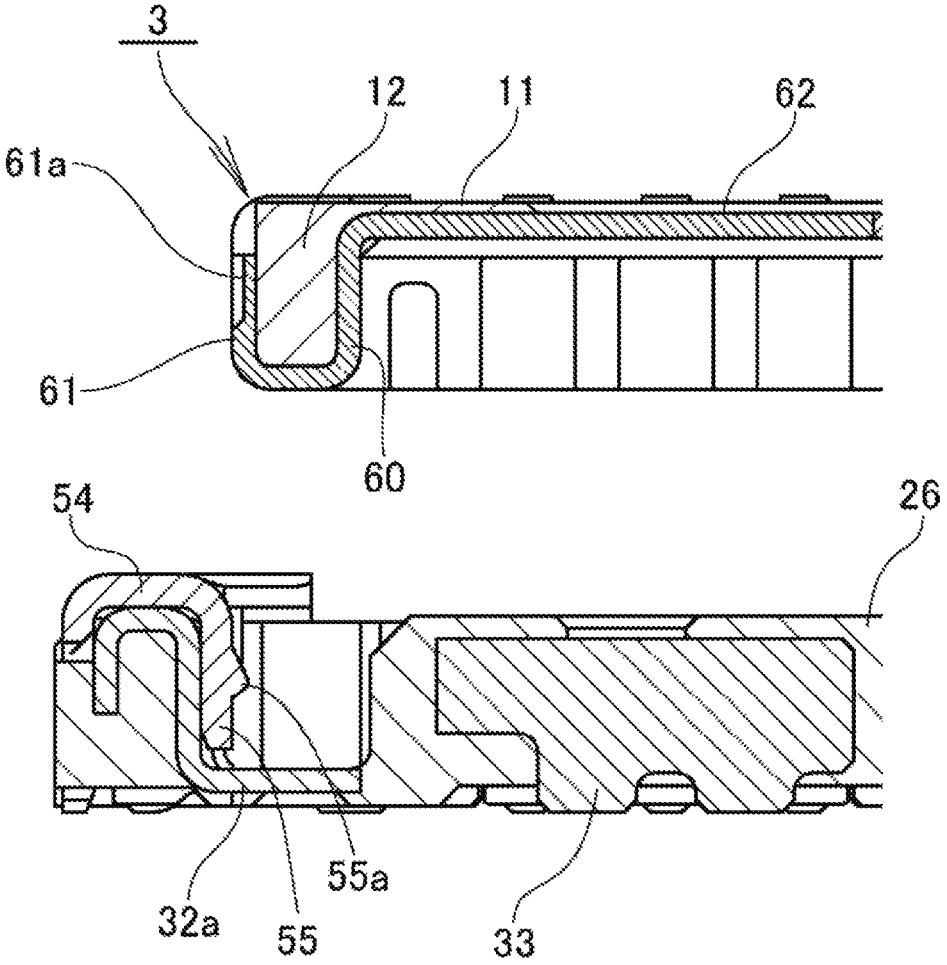
FIG. 11 is an exploded enlarged partial sectional view showing a state of connection of the plug and the socket when the shield plate shown in FIG. 9 is used.

The ground plates 29 are connected to the socket-side shield member 31. As shown in FIG. 11, when the plug 3 is connected to the socket 6, the shield plates 62 can thus be connected to the ground plates 29 via the socket-side shield member 31 for improved shield performance.

Figure 12:
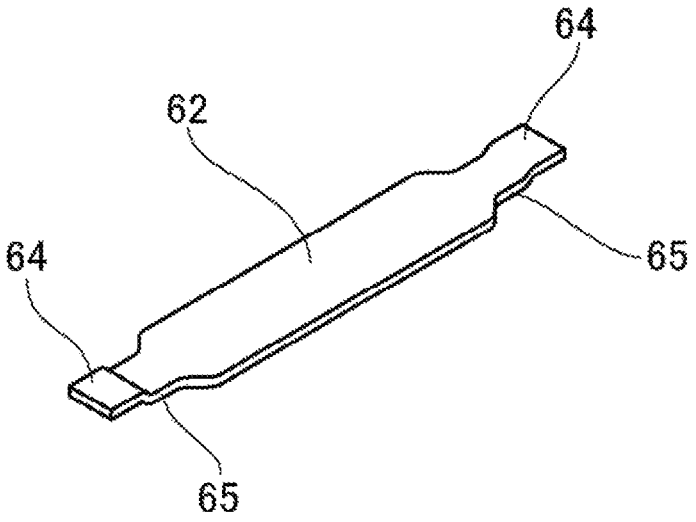
FIG. 12 is a perspective view showing yet another configuration of the shield plate.

As shown in FIG. 12, a shield plate 62 may include surface mounting terminals 64, 64 at both ends.

Figure 13:
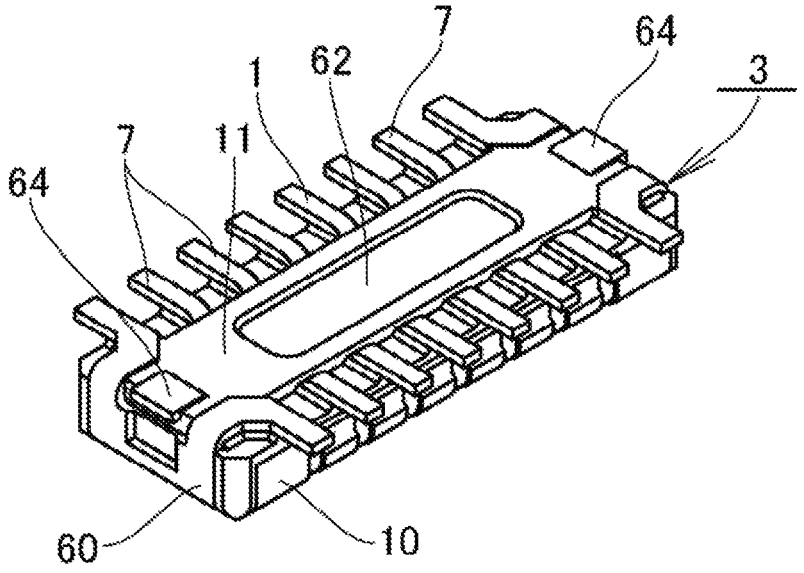
FIG. 13 is a perspective view showing a plug using the shield plate.

The surface mounting terminals 64, 64 are supported by end edges of the shield plate 62 via connection pieces 65 obliquely extended outward in a thickness direction. As shown in FIG. 13, when the shield plate 62 is assembled into the plug housing 10, the surface mounting terminals 64, 64 are exposed from the substrate-side surface of the plug 3.

The use of such a shield plate 62 enables grounding of the shield plate 62 when the surface mounting terminals 64, 64 are mounted on a ground pattern of a substrate.

The positions of the surface mounting terminals 64, 64 can be changed to use both the surface mounting terminals 64, 64 and the plug-side coupling metal pieces 60, 60 on the shield plate 62.

Figure 14:
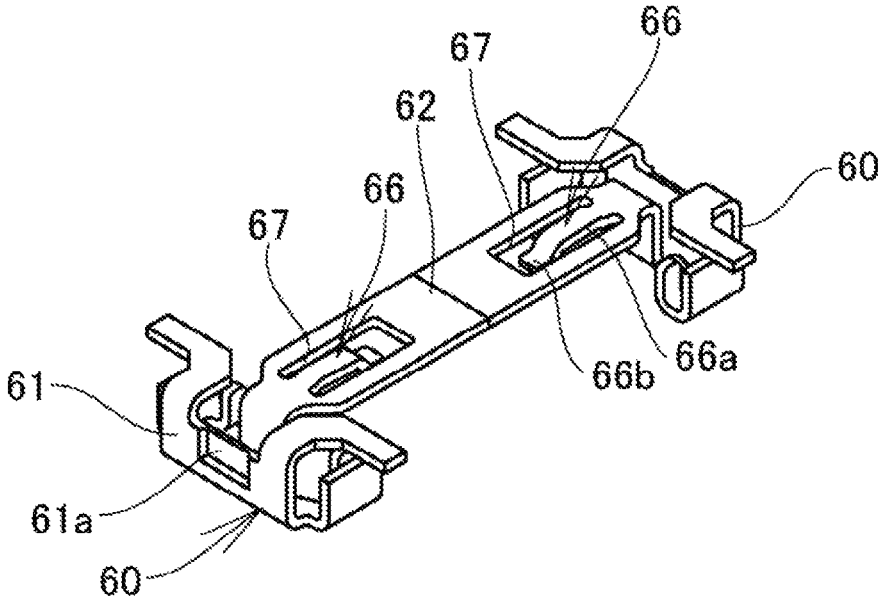
FIG. 14 is a perspective view showing yet another configuration of the shield plate.

As shown in FIG. 14, shield plates 62 may include plate contact portions 66 that make contact with the exposed top end surfaces of the ground plates 29. If the plate contact portions 66 are provided, the plate exposure windows 28, 28 are formed in the top surface of the plate holding wall portion 26 of the socket housing 20 so that part or all of the top end surfaces of the ground plates 29 are exposed.

Figure 15:
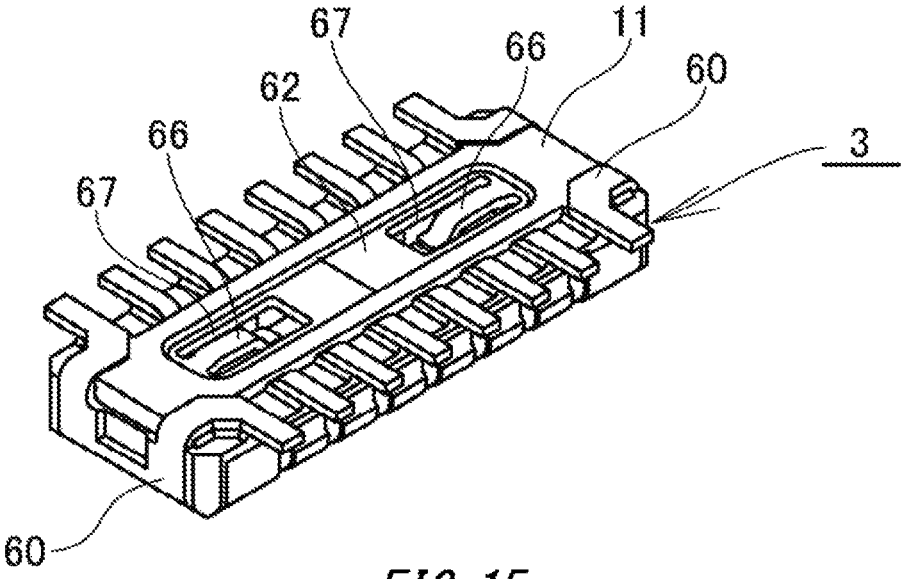
FIG. 15 is a perspective view showing a plug using the shield plate.
Figure 16:
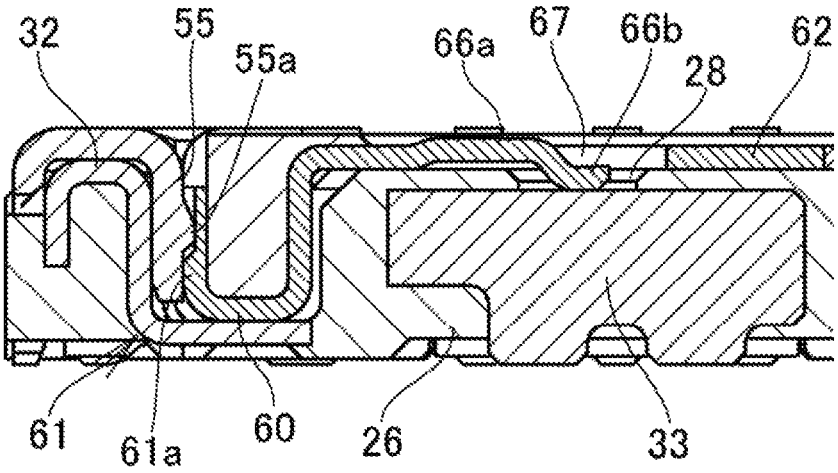
FIG. 16 is an enlarged partial sectional view showing a state of connection between the plug and the socket when the shield plate is used.
Figure 17A:
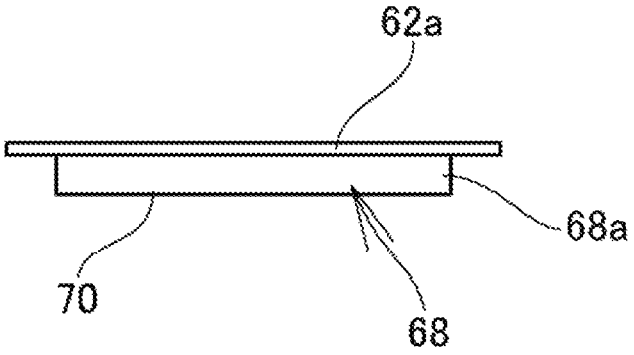
FIG. 17A is a front view showing yet another configuration of the shield plate.
Figure 17B:
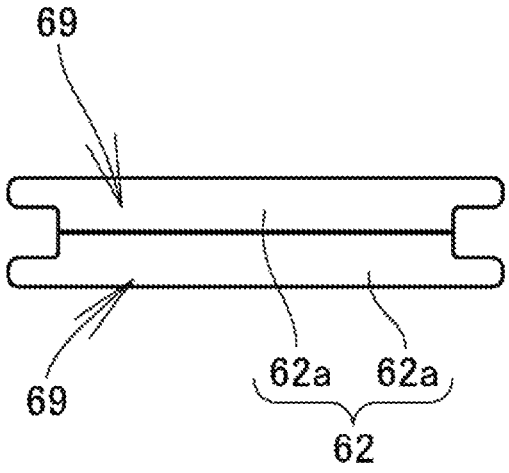
FIG. 17B a plan view showing the yet another configuration of the shield plate.
Figure 17C:
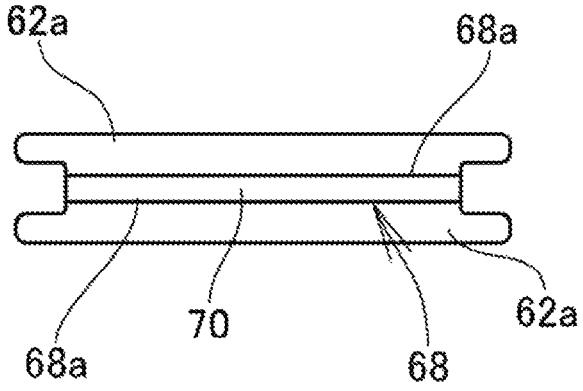
FIG. 17C a bottom view showing the yet another configuration of the shield plate.
Figure 17D:
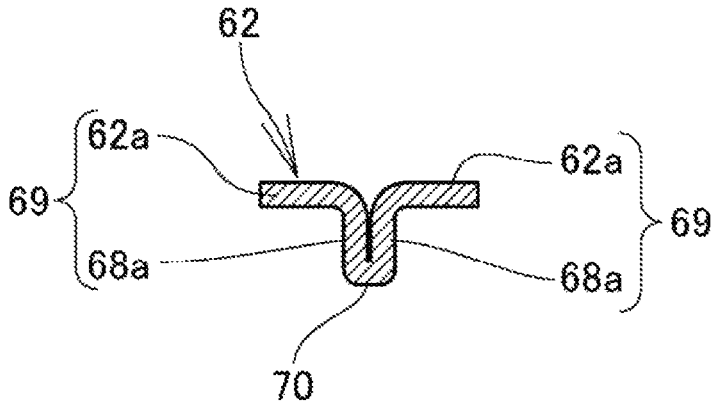
FIG. 17D a sectional view showing the yet another configuration of the shield plate.

The plate contact portions 66 shown in FIGS. 14 to 16 are formed by cutting and erecting part of the shield plates 62. The plate contact portions 66 are each formed like a cantilever spring that is supported at one end by an inner rim of a window 67 penetrating through the shield plate 62 in the thickness direction and makes a displacement in the thickness direction.

The plate contact portions 66 each include an elastic contactor 66*a* supported at one end by the rim of the window portion 67, and a contact portion 66*b* formed at the extremity of the elastic contactor 66*a*. The contact portion 66*b* protrudes to the socket side of the bottom plate portion 21 through the plate exposure portion 63.

As shown in FIG. 16, when the plug 3 is connected to the socket 6, the contact portions 66*b* are inserted into the plate exposure windows 28, 28. The contact portions 66*b* make contact with the top end surfaces of the plate main bodies 33 of the ground plates 29 exposed via the plate exposure windows 28, 28 at an appropriate contact pressure. This ensures conduction between the shield plates 62 and the ground plates 29, whereby leak-free high shieldability is obtained.

The plate contact portions are not limited to the foregoing ones having a cantilever spring shape. As shown in FIGS. 17A to 17D, a plate contact portion 68 of rib shape protruding from the ground plate 29-side surface of the shield plate 62 may be used.

This shield plate 62 includes a pair of shield plate members 69, 69 each including a shield plate main body 62*a* of flat plate shape and a plate contactor 68*a* perpendicularly protruded from a side edge of the shield plate main body 62*a*. The shield plate main bodies 62*a*, 62*a* butted against each other form a single shield plate 62 of flat plate shape. The plate contactors 68*a*, 68*a* put together constitute the plate contact portion 68 of rib shape.

Figure 19:
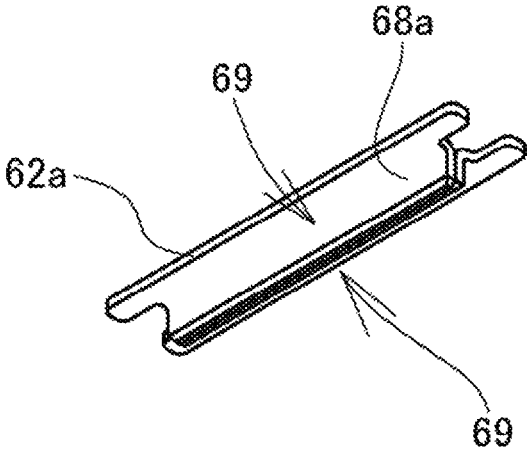
FIG. 19 is a perspective view showing yet another configuration of the shield plate.

As shown in FIGS. 17A to 17D, the pair of shield plate members 69, 69 may be configured so that the ground plate 29-side ends of the plate contactors 68*a*, 68*a* are connected to each other by a connection portion 70. As shown in FIG. 19, the pair of shield plate members 69, 69 may be independent of each other.

Figure 18:
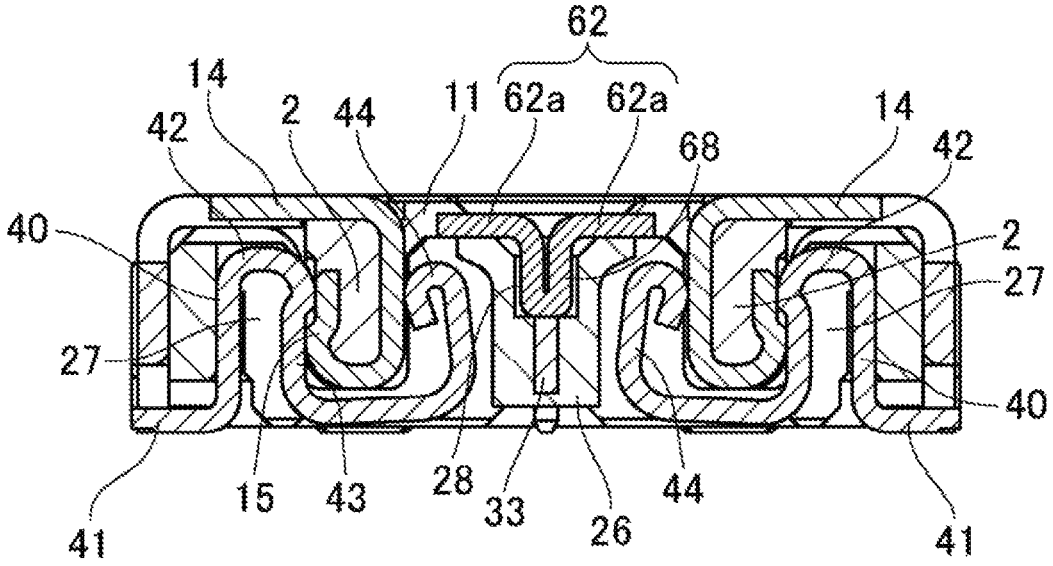
FIG. 18 is an enlarged partial sectional view showing a state of connection of the plug and the socket when the shield plate is used.

As shown in FIG. 18, when the plug 3 is connected to the socket 6, the plate contact portion 68 formed in such a rib shape is inserted into a plate exposure window 28 formed in a groove shape. The bottom end of the plate contact portion 68 makes contact with the top ends of the plate main bodies 33 of the ground plates 29.

The layout of the plug-side signal terminals 1, 1 and the plug-side ground terminal 7, 7 will be described. The plug-side signal terminals 1, 1 are located at predetermined positions according to design. The plug-side ground terminals 7, 7 are located on the basis of the positions of the plug-side signal terminals 1, 1 by taking into account suppression of signal interference and shielding characteristics between the signal terminals.

The plug-side signal terminals 1, 1 and the plug-side ground terminals 7, 7 are formed in the same shape. Each terminal is integrally formed by punching a punched member of predetermined shape from a conductive metal plate member, and folding the punched member in a thickness direction.

Figure 8A:
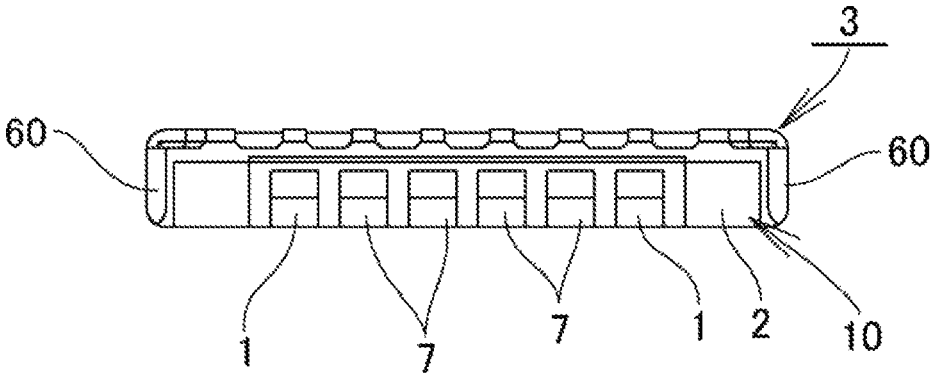
FIG. 8A is a front view showing a plug of the connector.
Figure 8B:
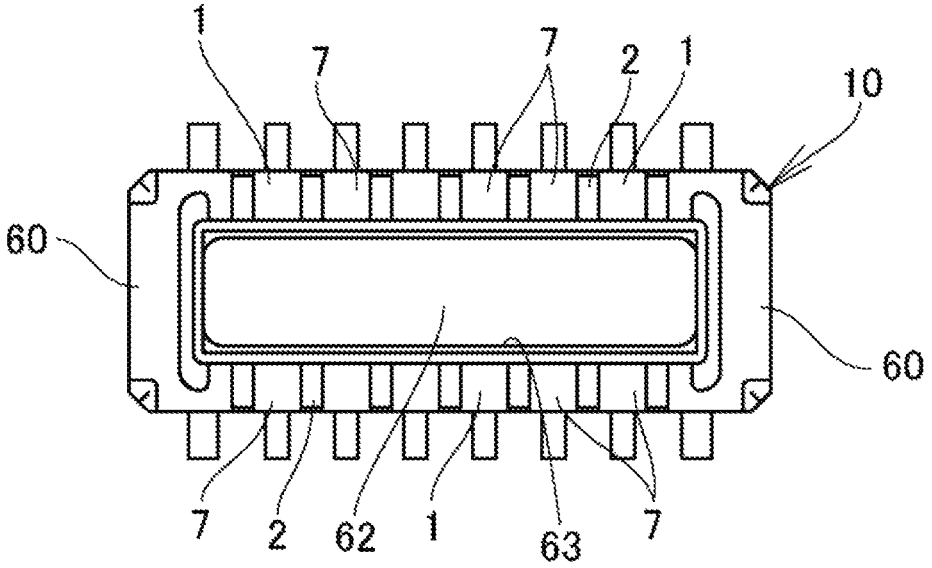
FIG. 8B is a bottom view of the plug of the connector
Figure 8C:
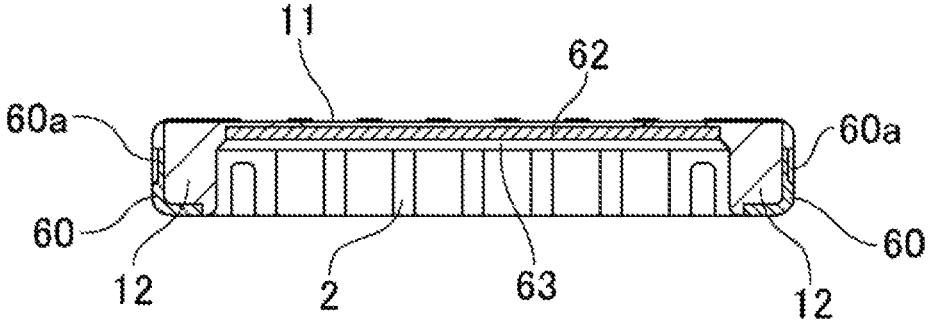
FIG. 8C is a longitudinal sectional view of the plug of the connector
Figure 8D:
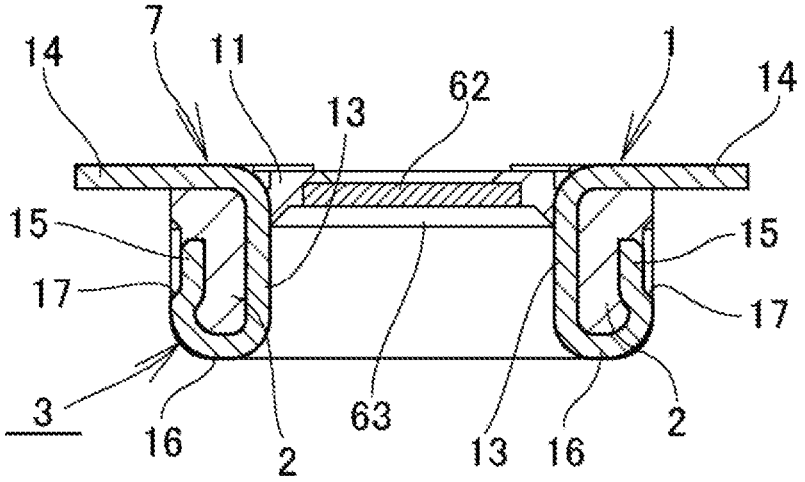
FIG. 8D is an enlarged sectional view of the plug of the connector.

As shown in FIG. 8D, the plug-side signal terminals 1, 1 and the plug-side ground terminals 7, 7 each include a contact portion piece 13, a substrate connection terminal piece 14, a plug-side engagement portion 15, and a connection piece 16. The contact portion pieces 13 have a flat plate shape and are held in a state of being exposed to inside the fitting protrusions 2, 2. The substrate connection terminal pieces 14 are bent perpendicularly outward from one end of the respective contact portion pieces 13. The plug-side engagement portions 15 are opposed to the contact portion pieces 13. The connection pieces 16 connect the ends of the contact portion pieces 13 and the plug-side engagement portions 15.

A holding rib portion (hereinafter, referred to as a plug-side holding rib portion) 17 continuous in a direction crossing the plug insertion and removal direction is formed on each plug-side engagement portion 15 by folding the punched member in a thickness direction.

The connector A configured thus includes the shield plate(s) 62 in the bottom plate portion of the plug housing 10. Since the shield plate(s) 62 constitute(s) the skeleton of the bottom plate portion 11, the entire connector can be made low-profile even if the shield plate(s) 62 cutting off the plug-side signal terminals 1 held by the fitting protrusions from each other is/are included.

In the connector A, the shield plate(s) 62 include(s) the plate contact portion(s) 66 or 68. When the plug 3 is fitted to the socket 6, the shield plate(s) 62 and the grand plates 29 are thereby connected. This enables cooperation of the shield plate(s) 62 and the ground plates 29 in terms of grounding performance, whereby signal interference between the signal terminals can be prevented without fail and the shielding function of the entire connector can be improved.

In the foregoing examples, the plate contact portions of spring shape and rib shape are described to be provided on the shield plate(s). However, the ground plates may include plate connection portions of spring shape that elastically make contact with the shield plate(s) exposed from the bottom plate portion of the plug housing.

REFERENCE SIGNS LIST

A connector
1 plug-side signal terminal
2 fitting protrusion
3 plug
4 fitting groove
5 socket-side signal terminal
6 socket
7 plug-side ground terminal
8 socket-side ground terminal
10 plug housing
11 bottom plate portion
12 end wall portion
13 contact portion piece
14 substrate connection terminal piece
15 plug-side engagement portion
16 connection piece
17 plug-side holding rib portion
20 socket housing
21 bottom plate portion
22 to 25 peripheral wall
26 plate holding wall portion
27 signal terminal insertion portion
28 plate exposure window
29 ground plate
31 socket-side shield member
32 connection portion
33 plate main body
40 terminal base piece
41 substrate connection terminal piece
42 connection piece
43 socket-side engagement portion
44 elastic contactor
50 to 53 peripheral wall portion
54 top covering portion
55 socket-side coupling metal piece
60 plug-side coupling metal piece
61 engagement plate portion
62 shield plate
63 plate exposure portion
64 surface mounting terminal
65 connection piece
66 plate contact portion
67 window portion
68 plate contact portion
69 shield plate member

The invention claimed is:

1. A connector comprising:

a plug configured to include a plug housing having a fitting protrusion of rib shape and one or a plurality of plug-side signal terminals arranged on the fitting protrusion; and a socket configured to include a socket housing having a fitting groove for the fitting protrusion to be fitted into, one or a plurality of socket-side connection terminals arranged in the fitting groove, and a ground plate made of conductive metal, the ground plate being held by the socket housing and vertically placed beside the fitting groove, the plug-side signal terminal(s) and the socket-side signal terminal(s) being in contact with each other by fitting the fitting protrusion to the fitting groove, wherein the plug is configured to include a shield plate made of a conductive plate member beside the plug-side signal terminal(s), a surface of the shield plate being opposed to a top end surface of the ground plate, wherein the shield plate is configured to include a plug-side coupling metal piece exposed on a side end surface of the plug housing, and the plug-side coupling metal piece is connected to a socket-side shield member.

2. The connector according to claim 1, wherein the shield plate is configured to include a surface mounting terminal portion exposed on a substrate mounting side of the plug housing.

3. The connector according to claim 2, wherein the ground plate is configured to include a plate connection portion that elastically makes contact with the shield plate exposed from a bottom plate portion of the plug housing.

4. The connector according to claim 1, wherein the ground plate is held by the socket housing with part or all of the top end surface thereof exposed, and the shield plate is configured to include a plate contact portion to make contact with the top end surface of the ground plate.

5. The connector according to claim 4, wherein the plate contact portion is formed like a spring supported at one end by an inner rim of a window portion penetrating through the shield plate in a thickness direction.

6. The connector according to claim 4, wherein the plate contact portion is formed like a rib protruding from a ground plate-side surface of the shield plate.

7. The connector according to claim 6, wherein the shield plate is configured to include a pair of shield plate members each including a shield plate main body of flat plate shape and a plate contactor perpendicularly protruded from a side edge of the shield plate main body, and the plate contact portion is formed by combining the plate contactors.

8. The connector according to claim 7, wherein ground plate-side ends of the plate contactors are connected by a connection portion.

9. A connector comprising:

a plug including a plug housing having a fitting protrusion of rib shape and one or a plurality of plug-side signal terminals arranged on the fitting protrusion; and a socket including a socket housing having a fitting groove for the fitting protrusion to be fitted into, one or a plurality of socket-side connection terminals arranged in the fitting groove, and a ground plate made of conductive metal, the ground plate being held by the socket housing and placed beside the fitting groove, the one or a plurality of plug-side signal terminals and the one or a plurality of socket-side signal terminals being in contact with each other when the fitting protrusion is fit into the fitting groove, wherein the plug further includes a shield plate made of a conductive plate member beside the one or a plurality of plug-side signal terminals, a surface of the shield plate being opposed to a top end surface of the ground plate, wherein the ground plate is held by the socket housing with part or all of the top end surface thereof exposed, the shield plate includes a pair of shield plate members each including a shield plate main body of flat plate shape, a plate contactor perpendicularly protruded from a side edge of the shield plate main body and a plate contact portion to make contact with the top end surface of the ground plate, the plate contact portion is formed by a combination of the plate contactor of each of the pair of shield plate members such that the plate contact portion is formed like a rib protruding from a ground plate-side surface of the shield plate, and ground plate-side ends of the plate contactors forming the rib are integral with one another to form a common connection portion.

* * * * *